US009915466B1

(12) United States Patent
Storch

(10) Patent No.: US 9,915,466 B1
(45) Date of Patent: Mar. 13, 2018

(54) COLD COMPARTMENT TEMPERATURE STABILIZATION IN REFRIGERATORS AND FREEZERS

(71) Applicant: Felix Storch, Inc., Bronx, NY (US)

(72) Inventor: Paul Storch, Bronx, NY (US)

(73) Assignee: Felix Storch, Inc., Bronx, NY (US)

( * ) Notice: Subject to any disclaimer, the term of this patent is extended or adjusted under 35 U.S.C. 154(b) by 0 days.

(21) Appl. No.: 15/171,086

(22) Filed: Jun. 2, 2016

(51) Int. Cl.
*F25D 23/06* (2006.01)

(52) U.S. Cl.
CPC ..... *F25D 23/066* (2013.01)

(58) Field of Classification Search
CPC ..... F25D 23/06; F25D 23/062; F25D 23/063; F25D 23/065; F25D 23/066
USPC ..... 312/400, 401, 406, 406.1; 62/440, 3.6, 62/531; 220/592.09, 592.2
See application file for complete search history.

(56) References Cited

U.S. PATENT DOCUMENTS 3,966,283 A * 6/1976 Puterbaugh ..... F25D 23/061 312/406
4,002,199 A * 1/1977 Jacobs ..... F25D 17/062 165/61
4,685,402 A * 8/1987 Nelson ..... E05G 1/024 109/65
5,695,867 A * 12/1997 Saitoh ..... B32B 15/04 428/219
5,725,294 A * 3/1998 Froelicher ..... F25D 21/04 312/400
5,842,353 A * 12/1998 Kuo-Liang ..... A47G 19/2288 219/419
6,422,024 B1 * 7/2002 Foye ..... A47G 19/2288 62/3.2
6,591,615 B1 * 7/2003 Luo ..... F25B 21/04 62/3.3
7,001,005 B2 * 2/2006 Gamberoni ..... F25D 23/062 220/592.1
2004/0182463 A1 * 9/2004 Bessette ..... B32B 1/08 138/143
2015/0143697 A1 * 5/2015 Cook ..... F25D 23/064 29/890.035
2016/0258671 A1 * 9/2016 Allard ..... F25D 23/065

* cited by examiner

*Primary Examiner* — James O Hansen
(74) *Attorney, Agent, or Firm* — Arthur Jacob

(57) ABSTRACT

A selected temperature is stabilized within the interior of a cold compartment of a refrigerator or freezer wherein the selected temperature is effected by a refrigeration system operated in cycles of operation comprised of ON periods and OFF periods. A lining is extended along the perimeter of the interior of the compartment, exposed to the interior, the lining being constructed of a material having a combination of thermal conductivity and thermal mass enabling the conduct of heat into the interior of the compartment during the ON periods and the absorption of heat from the interior of the compartment during the OFF periods, whereby the temperature within the interior of the compartment essentially is stabilized at the selected temperature during cyclical operation of the refrigeration system.

8 Claims, 2 Drawing Sheets

FIG. 1
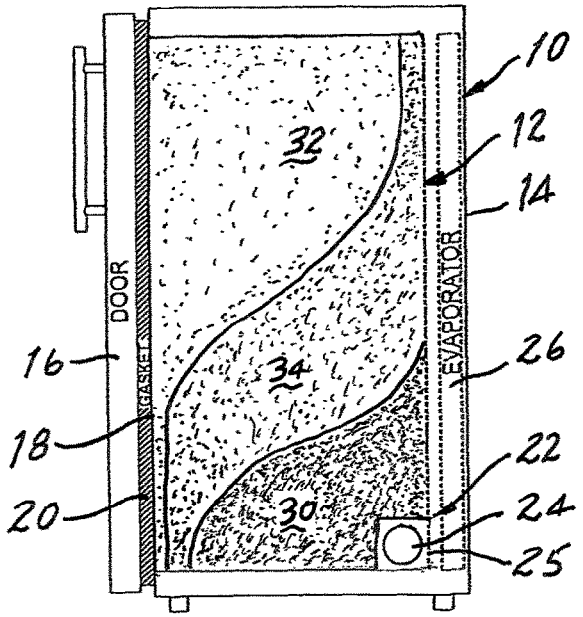
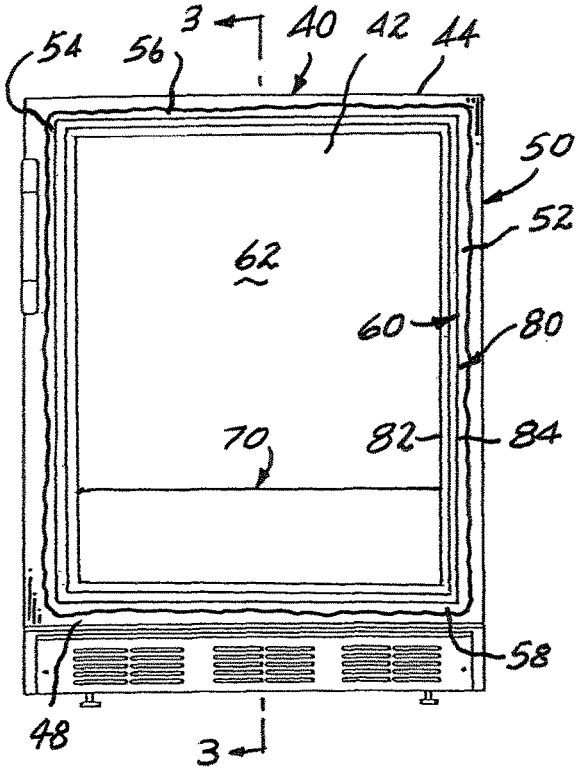
FIG. 2
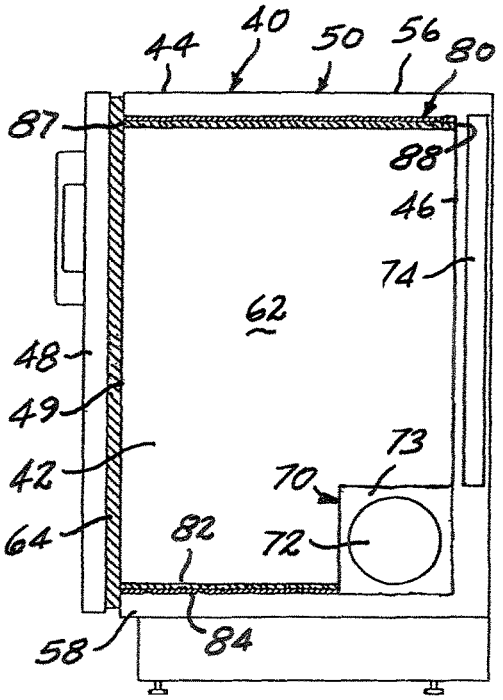
FIG. 3

COLD COMPARTMENT TEMPERATURE STABILIZATION IN REFRIGERATORS AND FREEZERS

The present invention relates generally to stabilizing temperature within a cold compartment of a refrigerator or freezer in which a selected temperature is maintained by a refrigeration system operated intermittently, in cycles of operation between ON periods and OFF periods, and pertains, more specifically, to maintaining a selected temperature within the interior of the cold compartment to secure a more uniform temperature within the cold compartment for the storage of high-value substances such as certain vaccines and industrial products comprised of temperature-sensitive materials that can be rendered worthless should the internal temperature of the compartment within which such substances are stored go out of a prescribed holding range for that product.

Conventional refrigerators and freezers are prone to temperature gradients within the cold compartments of such refrigerators and freezers. Thus, during cyclical operation of the refrigeration systems of such refrigerators and freezers, these compartments tend to be colder toward the bottom of the compartment and warmer toward the top of the compartment, as a result of warmer air rising and colder air falling within the compartment. Typically, these differences in temperature can range from four to eight degrees or more between the top and bottom of the cold compartment. Further, temperature gradients also become established between the front and rear of cold compartments since evaporator units usually are placed at the rear, while a front door, when opened, subjects the interior to ambient temperature. While such temperature gradients pose no significant problem in household or commercial refrigerators where a high percentage of the interior volume of a cold compartment is filled with food and beverages that can tend to resist relatively large variations in interior temperature, refrigerators and freezers employed in scientific, laboratory, medical, pharmaceutical and industrial applications often are operated with a low percentage of the volume of the interior of a cold compartment filled, and specifications for the storage of materials in these venues require a very high uniformity in selected interior temperature in all sections of the compartment.

Some conventional refrigerators and freezers rely upon fans and airflow induced by such fans to reduce temperature gradients within a cold compartment; however, fans have been found to be only partially effective in overcoming the aforesaid temperature gradients, particularly where the configuration or contents of the cold compartment can interfere with the full circulation of air within the compartment.

The present invention provides an improvement for stabilizing the temperature within the interior of a cold compartment of a refrigerator or freezer in which the temperature within the cold compartment normally is maintained by a refrigeration system operated intermittently, in cycles of operation comprised of ON periods and OFF periods. As such, the present invention attains several objects and advantages, some of which are summarized as follows: Provides a more uniform selected temperature throughout a cold compartment of a refrigerator or freezer in which a refrigeration system is operated in cycles of operation between ON periods and OFF periods, for the effective storage of temperature-sensitive materials; more effectively stabilizes the interior temperature of a cold compartment of a refrigerator or freezer, independent of the volume or location of contents stored within the cold compartment; accomplishes stabilization of a selected temperature within a cold compartment of a refrigerator or freezer without requiring a major structural departure from conventional construction; provides a relatively simple and economical construction and method for the effective stabilization of a selected temperature within a cold compartment of a refrigerator or freezer comprised of a conventional intermittently operated refrigeration system; enables the attainment of well-regulated technical specifications in maintaining a desired temperature in a cold compartment of a refrigerator or freezer without increasing energy consumption or mechanical complexity; provides a relatively simple and highly reliable construction and method capable of exemplary performance over an extended service life.

The above objects and advantages, as well as further objects and advantages, are attained by the present invention, which may be described briefly as an improvement for stabilizing a selected temperature within the interior of a cold compartment wherein the selected temperature is effected by a refrigeration system operated in cycles of operation comprised of ON periods and OFF periods, the cold compartment having a surrounding wall, the improvement comprising: a lining juxtaposed with and extending along the surrounding wall, exposed to the interior of the cold compartment; the lining being constructed of a material having a combination of thermal conductivity and thermal mass for absorbing heat from the interior of the cold compartment during the OFF periods and conducting heat into the interior of the cold compartment during the ON periods, whereby the temperature within the interior of the cold compartment essentially is stabilized at the selected temperature during cyclical operation of the refrigeration system.

In addition, the present invention provides a method for stabilizing a selected temperature within the interior of a cold compartment wherein the selected temperature is effected by a refrigeration system operated in cycles of operation comprised of ON periods and OFF periods, the cold compartment having a surrounding wall, the improvement comprising: juxtaposing a lining with the surrounding wall and extending the lining along the surrounding wall such that the lining is exposed to the interior of the cold compartment; and constructing the lining of a material having a combination of thermal conductivity and thermal mass to conduct heat into the interior of the cold compartment during the ON periods and to absorb heat from the interior of the cold compartment during the OFF periods, whereby the temperature within the interior of the cold compartment essentially is stabilized at the selected temperature during cyclical operation of the refrigeration system.

The invention will be understood more fully, while still further objects and advantages will become apparent, in the following detailed description of preferred embodiments of the invention illustrated in the accompanying drawing, in which:

FIG. 1 is a diagrammatic, cross-sectional view illustrating zones within a conventional refrigerator operated intermittently through ON periods and OFF periods;

FIG. 2 is a front elevational view, largely broken away, showing a refrigerator incorporating an improvement constructed and operating in accordance with the present invention;

FIG. 3 is a cross-sectional view taken partially along line 3-3 of FIG. 2;

Figure 4:
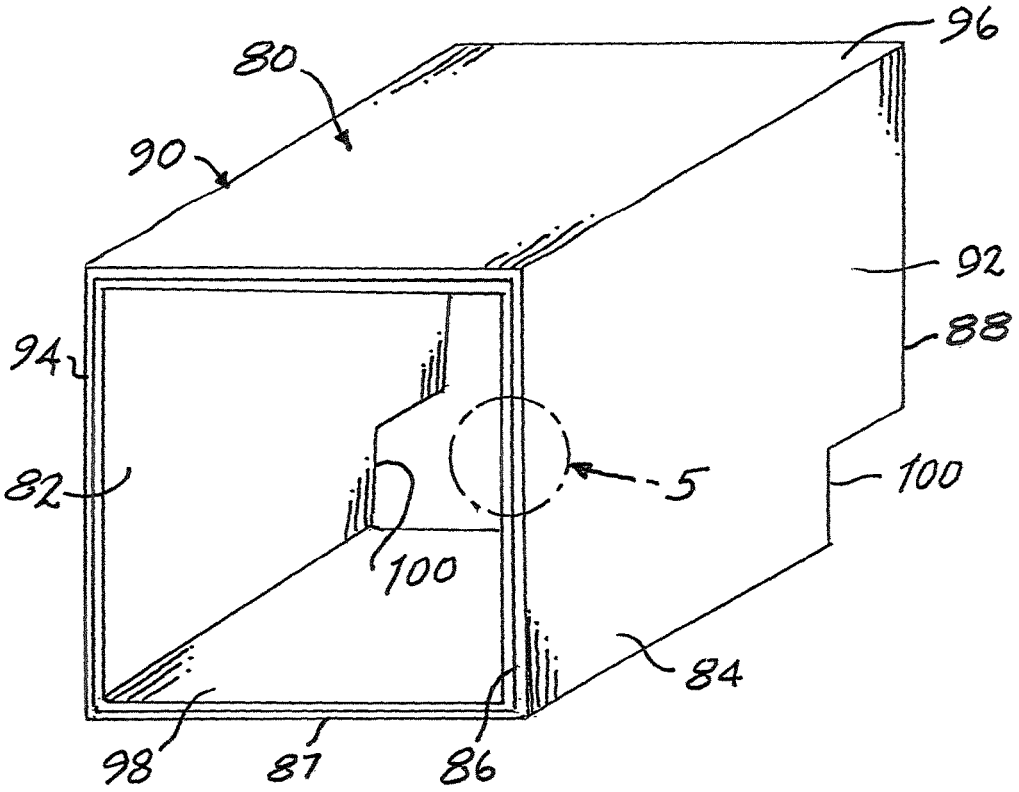
FIG. 4 is a pictorial view of a component constructed in accordance with the improvement of the present invention.

Referring now to the drawing and, in particular, to FIG. 1 thereof, a conventional refrigerator is shown at 10 and is seen to have an internal cold compartment 12 encased within a case 14. An access door 16 is placed over an access opening 18 and a gasket 20 seals the access opening 18 when the door 16 is closed, all in a now conventional manner. A refrigeration system 22 includes a compressor 24 located in a compressor compartment 25 and an evaporator 26 located adjacent the rear of the case 14. Refrigeration system 22 is operated intermittently, that is, cyclically with compressor 24 operating in cycles of operation comprised of ON periods and OFF periods. Since cold air is denser than warm air, cooler air within cold compartment 12 will migrate toward the bottom of cold compartment 12, while warmer air will rise toward the top of cold compartment 12. Thus, items stored at the bottom of cold compartment 12 will tend to be colder than those stored at the top. In addition, since the evaporator 26 is quite cold, items placed nearer the evaporator 26 often are rendered colder than items placed farther away from the evaporator 26. Further, items placed near access door 16 tend to be warmer than items placed elsewhere in cold compartment 12 as a result of being subjected to ambient air rushing in when the access door 16 is opened, or as a result of leakage through and around gasket 20.

The cycled operation of compressor 24 results in natural temperature gradients within cold compartment 12, shown diagrammatically in the form of colder zone 30 adjacent the bottom of cold compartment 12, a warmer zone 32 adjacent the top of cold compartment 12 and an intermediate zone 34 between the colder zone 30 and the warmer zone 32. Ordinarily, warmer zone 32 extends downwardly to the bottom of cold compartment 12 adjacent access opening 18, as does intermediate zone 34, as a result of some exposure to the ambient environment through access opening 18. While the natural temperature gradients illustrated in FIG. 1 are quite acceptable in refrigerators serving such domestic or commercial needs as the storage of food, beverages and the like, these natural temperature gradients are unacceptable in refrigerators and freezers employed for the storage of certain pharmaceuticals, industrial products, laboratory reagents and many other high-value items that will degrade much more quickly at temperatures that deviate from a selected temperature. Thus, items stored nearer the top of cold compartment 12 could be subjected to temperatures higher than the selected temperature, leading to degradation of such items. Items stored nearer the bottom, and rear, of cold compartment 12 could be subjected to temperatures lower than the selected temperature, including a freezing temperature which could render such items inert and useless.

A number of techniques currently are used in attempts to minimize temperature variations within a cold compartment such as cold compartment 12. For example, better insulation is used to reduce heat loss through the walls surrounding a cold compartment. However, while such a measure can reduce energy consumption, the measure often has the opposite effect on temperature uniformity because such lower heat loss can lengthen the OFF period of the cyclical operation of the refrigeration system, leading to greater temperature gradients within the cold compartment before commencement of the ON period of the cyclical operation. The use of fans to establish an even temperature throughout a cold compartment has been found to be somewhat effective; however, fans have limitations, such as increased energy consumption, dead spots created within a cold compartment by structural features or by the location of items within the cold compartment, or by driving cooled air out of the cold compartment when an access door is opened. Accordingly, there is a need for a more effective and practical way of attaining a stabilized selected temperature within a cold compartment of a refrigerator or freezer.

Figure 5:
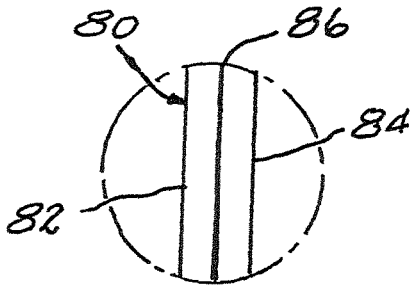
FIG. 5 is an enlarged fragmentary view of a portion of FIG. 4 indicated at arrow 5.

Turning now to FIGS. 2 through 5, a refrigerator 40 is seen to have a cold compartment 42 encased within a case 44 that includes a rear wall 46, a front wall in the form of an access door 48 placed over an access opening 49, and side walls 50 including a right side wall 52, a left side wall 54, a top side wall 56 and a bottom side wall 58, the side walls 50 together with the rear wall 46 and front wall establishing a full surrounding wall 60 around the interior 62 of cold compartment 42. A gasket 64 serves to seal the access opening 49 when the access door 48 is closed. A refrigeration system 70 includes a compressor 72, located in a compressor compartment 73, and an evaporator 74, located adjacent rear wall 46 of case 44. Compressor 72 is operated in cycles of operation comprised of ON periods and OFF periods, establishing cyclical operation of refrigeration system 70, in a now conventional manner.

The present invention provides an improvement for stabilizing a selected temperature within the interior 62 of the cold compartment 42. The improvement comprises placing a lining, shown in the form of a sleeve 80, in juxtaposition with at least the side walls 50 and extending along the surrounding wall 60, exposed to the interior 62 of cold compartment 42. Sleeve 80 is constructed of a material having a combination of thermal conductivity and thermal mass for conducting heat into the interior 62 of the cold compartment 42 during the ON periods of operation of refrigeration system 70, that is, during operation of compressor 72, and for absorbing heat from the interior 62 of the cold compartment 42 during the OFF periods. In this manner the temperature within the interior 62 of the cold compartment 42 essentially is stabilized at the selected temperature during cyclical operation of the refrigeration system 70.

Thermal conductivity is a measure of the ability of a material to conduct heat rapidly. For example, aluminum has a relatively high degree of thermal conductivity in that aluminum can conduct heat quickly. Thermal mass is a measure of the ability of a material to absorb and retransmit heat rapidly. For example, galvanized steel and stainless steel each possess a high degree of thermal mass, reflected in their ability to absorb and rapidly retransmit heat. In the illustrated embodiment of the present improvement, sleeve 80 is constructed of a first layer 82 of a metal of high thermal conductivity located contiguous with the interior 62 of the cold compartment 42, and a second layer 84 of a metal of high thermal mass contiguous with the first layer 82 and placed between the first layer 82 and side walls 50. The preferred material for first layer 82 is aluminum, while the preferred material for second layer 84 is steel, preferably galvanized steel or stainless steel. The layers 82 and 84 preferably are bonded together at 86. In this manner, during OFF periods of operation of compressor 72 heat from interior 62 of cold compartment 42 is conducted rapidly through aluminum first layer 82 to be absorbed within steel second layer 84, thereby stabilizing the temperature within the interior 62 of cold compartment 42. During ON periods of operation of compressor 72 heat from steel second layer 84 is transmitted rapidly through aluminum first layer 82 into interior 62 of cold compartment 42, thereby continuing the stabilization of the temperature within the interior 62 of cold compartment 42. In this manner a selected temperature is maintained within the interior of cold compartment 42 during cyclical operation of the refrigeration system 70.

In the preferred construction, sleeve 80 extends from a front end 87 to a rear end 88 and is configured with an overall configuration 90 that corresponds closely to the configuration of cold compartment 42 along side walls 50 so that sleeve 80 is fitted within the interior 62 of cold compartment 42 in close juxtaposition with side walls 50, occupying a minimal volume of the interior 62 so as to preserve a maximum storage volume within cold compartment 42. In the illustrated embodiment, sleeve 80 is provided with a generally tubular overall configuration 90 having an essentially continuous rectangular cross-section corresponding to the cross-sectional configuration of cold compartment 42. Thus, configuration 90 of sleeve 80 includes a right side wall 92 corresponding to and generally complementary to the inside of right side wall 52 of case 44, a left side wall 94 corresponding to and generally complementary to the inside of left side wall 54, a top side wall corresponding to and generally complementary to top side wall 56, and a bottom side wall 98 corresponding to and generally complementary to bottom side wall 58. Right side wall 92 and left side wall 94 each include a notch 100 at the rear end 88 of sleeve 80 to accommodate compressor compartment 73. Front end 87 of sleeve 80 is placed in close juxtaposition with access door 48 of cold compartment 42, and rear end 88 is placed in close juxtaposition with rear wall 46 such that sleeve 80 is in close juxtaposition with walls 50 from top to bottom and from front to rear of cold compartment 42, enabling a rapid flow of heat from top to bottom and from front to rear of cold compartment 42 through sleeve 80, rather than through the air within interior 62, to reduce any temperature gradient within interior 62 and thereby effect the desired stabilization of the temperature within cold compartment 42. In this manner, the volume of interior 62 of cold compartment 42 is conserved, while the effectiveness of sleeve 80 is maximized in stabilizing the temperature at a selected value within cold compartment 42 during cyclical operation of refrigeration system 70.

It will be seen that the present invention attains all of the objects and advantages summarized above, namely: Provides a more uniform selected temperature throughout a cold compartment of a refrigerator or freezer in which a refrigeration system is operated in cycles of operation between ON periods and OFF periods, for the effective storage of temperature-sensitive materials; more effectively stabilizes the interior temperature of a cold compartment of a refrigerator or freezer, independent of the volume or location of contents stored within the cold compartment; accomplishes stabilization of a selected temperature within a cold compartment of a refrigerator or freezer without requiring a major structural departure from conventional construction; provides a relatively simple and economical construction and method for the effective stabilization of a selected temperature within a cold compartment of a refrigerator or freezer comprised of a conventional intermittently operated refrigeration system; enables the attainment of well-regulated technical specifications in maintaining a desired temperature in a cold compartment of a refrigerator or freezer without increasing energy consumption or mechanical complexity; provides a relatively simple and highly reliable construction and method capable of exemplary performance over an extended service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. An apparatus for stabilizing a selected temperature within the interior of a cold compartment wherein the selected temperature is effected by a refrigeration system operated to remove heat from the interior of the cold compartment in cycles of operation comprised of ON periods, during which heat is removed from the interior of the cold compartment, and OFF periods, during which heat accumulates in the interior of the cold compartment, the cold compartment having a surrounding wall including side walls extending between front and rear walls, the apparatus comprising:

a lining having an extent for juxtaposition with and extending along the surrounding wall, exposed to the interior of the cold compartment, the lining being dimensioned and configured to be juxtaposed with and extend over the side walls of the cold compartment from adjacent one to adjacent the other of the front and rear walls;

the lining being constructed of a first layer of a material comprised of a metal of high thermal conductivity, the first layer having an extent for placement contiguous with the interior of the cold compartment, coextensive with the side walls of the surrounding wall of the cold compartment, and a second layer of a material comprised of a metal of high thermal mass contiguous with the first layer over essentially the entire extent of the first layer and located for placement between the first layer and the surrounding wall of the cold compartment, the first and second layers being coextensive in contiguity with one another throughout the entire extent of the lining, such that during the OFF periods heat will be conducted from the interior of the cold compartment, through the first layer and into the second layer to be absorbed within the second layer, and during the ON periods heat will be conducted from the second layer, through the first layer and into the interior of the cold compartment to be removed by the refrigeration system, whereby the temperature within the interior of the cold compartment essentially will be stabilized at the selected temperature during cyclical operation of the refrigeration system.

2. The apparatus of claim 1 wherein the material of the first layer comprises aluminum.

3. The apparatus of claim 2 wherein the material of the second layer comprises steel.

4. The apparatus of claim 1 wherein the material of the first layer is comprised of aluminum and the material of the second layer is comprised of a metal selected from the group consisting of galvanized steel and stainless steel.

5. A method for stabilizing a selected temperature within the interior of a cold compartment wherein the selected temperature is effected by a refrigeration system operated to remove heat from the interior of the cold compartment in cycles of operation comprised of ON periods, during which heat is removed from the interior of the cold compartment, and OFF periods, during which heat accumulates in the interior of the cold compartment, the cold compartment having a surrounding wall, including side walls extending between front and rear walls, the method comprising:

placing a lining in juxtaposition with the surrounding wall, and extending the lining along the surrounding wall such that the lining is exposed to the interior of the cold compartment; and constructing the lining of a first layer of a material comprised of a metal of high thermal conductivity and having an extent such that upon placement contiguous with the interior of the cold compartment, the first layer extends coextensive with the side walls of the surrounding wall of the cold compartment, from adjacent one to adjacent the other of the front and rear walls, and a second layer of a material comprised of a metal of high thermal mass contiguous with the first layer over essentially the entire extent of the first layer and located for extending between the first layer, and the surrounding wall of the cold compartment upon placement of the liner contiguous with the interior of the cold compartment, with the first and second layers coextensive in contiguity with one another throughout the entire extent of the lining, such that during the OFF periods heat is conducted from the interior of the cold compartment, through the first layer and into the second layer and absorbed within the second layer, and during the ON periods heat is conducted from the second layer through the first layer and into the interior of the cold compartment and removed by the refrigeration system, whereby the temperature within the interior of the cold compartment essentially is stabilized at the selected temperature during cyclical operation of the refrigeration system.

6. The method of claim 5 including constructing the first layer of a metal comprising aluminum.

7. The method of claim 6 including constructing the second layer of a metal comprising steel.

8. The method of claim 5 including constructing the first layer of a metal comprising aluminum, and constructing the second layer comprised of a metal selected from the group consisting of galvanized steel and stainless steel.

* * * * *